US011765505B2

(12) United States Patent
Watanabe et al.

(10) Patent No.: US 11,765,505 B2
(45) Date of Patent: Sep. 19, 2023

(54) CORRECTION METHOD OF ACOUSTIC CHARACTERISTICS, ACOUSTIC CHARACTERISTIC CORRECTION DEVICE AND NON-TRANSITORY STORAGE MEDIUM

(71) Applicant: YAMAHA CORPORATION, Hamamatsu (JP)

(72) Inventors: Takayuki Watanabe, Hamamatsu (JP); Akihiro Miwa, Kosai (JP)

(73) Assignee: YAMAHA CORPORATION, Hamamatsu (JP)

( * ) Notice: Subject to any disclaimer, the term of this patent is extended or adjusted under 35 U.S.C. 154(b) by 70 days.

(21) Appl. No.: 17/343,869

(22) Filed: Jun. 10, 2021

(65) Prior Publication Data

US 2021/0400386 A1 Dec. 23, 2021

(30) Foreign Application Priority Data

Jun. 18, 2020 (JP) ..... 2020-105517

(51) Int. Cl.

| | |
|---|---|
| ***H04R 29/00*** | (2006.01) |
| ***H04R 3/12*** | (2006.01) |
| ***H04R 1/40*** | (2006.01) |
| ***H04R 3/04*** | (2006.01) |
| ***H04R 27/00*** | (2006.01) |

(52) U.S. Cl.

CPC ..... *H04R 3/12* (2013.01); *H04R 1/403* (2013.01); *H04R 3/04* (2013.01); *H04R 27/00* (2013.01); *H04R 29/002* (2013.01); *H04R 2430/01* (2013.01)

(58) Field of Classification Search

CPC .... H04R 29/001; H04R 2430/01; H04R 3/04; H04R 3/02; H04R 1/403; H04R 3/12

USPC ..... 381/56–59, 98–99, 104–109

See application file for complete search history.

(56) References Cited

U.S. PATENT DOCUMENTS

| | | | | |
|---|---|---|---|---|
| 5,642,425 | A | 6/1997 | Kawakami | |
| 8,082,051 | B2 | 12/2011 | Mihelich | |
| 9,641,952 | B2 * | 5/2017 | Fejzo | H04R 5/02 |
| 9,882,303 | B1 * | 1/2018 | Chalas | H01R 13/424 |
| 9,883,303 | B2 * | 1/2018 | Hashimoto | H04R 29/001 |
| 10,904,691 | B2 * | 1/2021 | Tu | H04S 1/007 |

(Continued)

FOREIGN PATENT DOCUMENTS

| | | | |
|---|---|---|---|
| EP | 1349427 | A2 | 10/2003 |
| JP | H02193500 | A | 7/1990 |
| JP | H06284493 | A | 10/1994 |

OTHER PUBLICATIONS

Extended European search report issued in European Appln. No. 21179733.7 dated Nov. 15, 2021.

*Primary Examiner* — Disler Paul

(74) *Attorney, Agent, or Firm* — ROSSI, KIMMS & McDOWELL LLP

(57) ABSTRACT

A correction method of acoustic characteristics of a plurality of speakers installed in a room, the correction method groups speakers, among the plurality of speakers, having identical attachment condition to the above-mentioned room, measures each of output characteristics of the grouped speakers, calculates an average characteristic of the output characteristics of the grouped speakers, and corrects each of the output characteristics of the grouped speakers based on the average characteristic.

17 Claims, 9 Drawing Sheets

(56) References Cited

U.S. PATENT DOCUMENTS

| | | | | |
|---|---|---|---|---|
| 10,956,114 | B2 * | 3/2021 | Yu | H04W 56/005 |
| 11,194,542 | B2 * | 12/2021 | Yu | G11B 27/10 |
| 11,410,325 | B2 * | 8/2022 | Patil | G02B 27/0172 |
| 2008/0049948 | A1 | 2/2008 | Christoph | |
| 2012/0224701 | A1 | 9/2012 | Sakai | |
| 2015/0139427 | A1 * | 5/2015 | Sakai | H04S 5/02 381/17 |

* cited by examiner

CORRECTION METHOD OF ACOUSTIC CHARACTERISTICS, ACOUSTIC CHARACTERISTIC CORRECTION DEVICE AND NON-TRANSITORY STORAGE MEDIUM

CROSS REFERENCE TO RELATED APPLICATIONS

This Nonprovisional application claims priority under 35 U.S.C. § 119(a) on Patent Application No. 2020-105517 filed in Japan on Jun. 18, 2020, the entire contents of which are hereby incorporated by reference.

BACKGROUND

1. Technical Field

An exemplary embodiment of the disclosure relates to a method for correcting acoustic characteristics of a speaker and a room, an acoustic characteristic correction device, and a non-transitory storage medium storing a program executable by a computer to execute the method for correcting acoustic characteristics.

2. Background Information

Unexamined Japanese Patent Publication No. H06-284493 discloses configuration that performs a process of supporting a sound field. In such configuration, sound obtained by a microphone is processed through a FIR (Finite Impulse Response) filter to generate reverberant sound, and the reverberant sound is outputted from a plurality of speakers installed indoors.

Unexamined Japanese Patent Publication No. H02-193500 discloses a method of measuring output characteristics of a speaker using a microphone installed indoors to correct frequency characteristics.

SUMMARY

In the case where a device for enabling a sound field to be changed electrically or the like is introduced into a facility such as a concert hall, many speakers need to be attached. In this case, the attached speakers each may be prevented from exerting its original characteristics due to installation conditions. Therefore, correction is needed for each speaker individually. However, individual correction of many speakers requires a lot of time and effort.

Accordingly, an exemplary embodiment of the disclosure aims to provide a correction method of acoustic characteristics that corrects an influence of attachment conditions on output characteristics quantitatively with respect to a target characteristic and reduces time and effort required for the correction, and an acoustic characteristic correction device.

A correction method of acoustic characteristics of a plurality of speakers installed in a room in accordance with an exemplary embodiment of the present disclosure groups speakers, among the plurality of speakers, having identical attachment condition to the room, measures each of output characteristics of the grouped speakers, calculates an average characteristic of the output characteristics of the grouped speakers, and corrects each of the output characteristics of the grouped speakers based on the average characteristic.

The correction method of the acoustic characteristics in accordance with the exemplary embodiment of the present disclosure can correct an influence of attachment conditions on output characteristics quantitatively with respect to a target characteristic, and reduce time and effort required for the correction.

DETAILED DESCRIPTION

Figure 1:
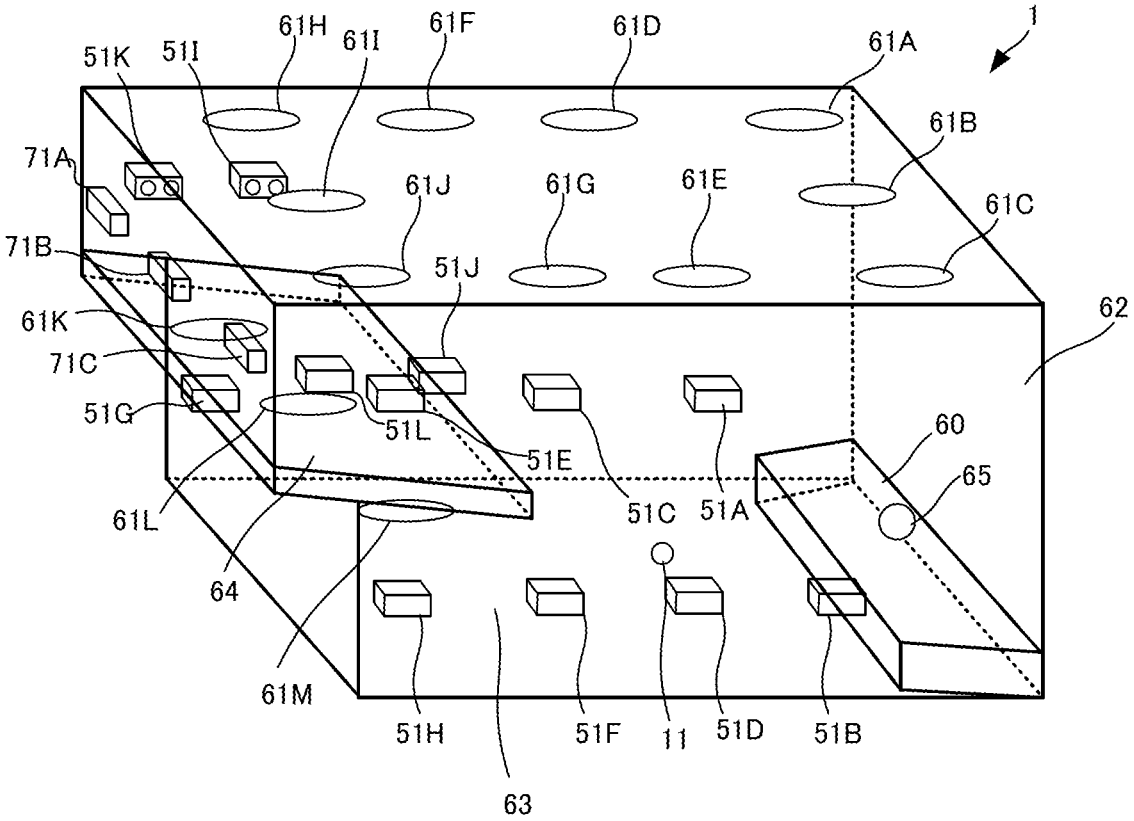
FIG. 1 is a transparent perspective view schematically showing a room 62.
Figure 2:
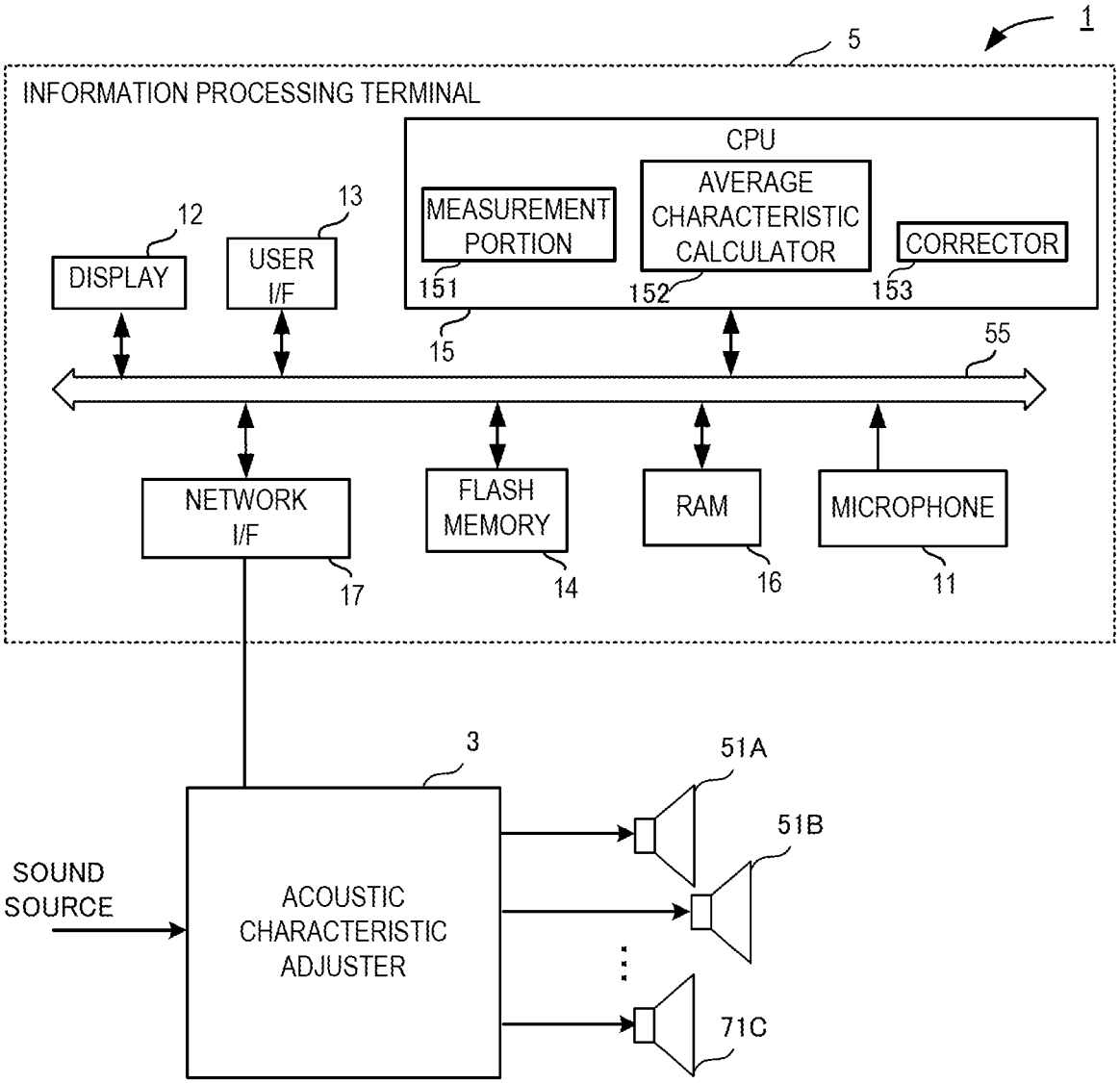
FIG. 2 is a block diagram showing configuration of a sound system.

FIG. 1 is a transparent perspective view schematically showing a room 62 that constitutes a space. FIG. 2 is a block diagram showing configuration of a sound system 1. The sound system 1 includes a plurality of speakers, an acoustic characteristic adjuster 3 connected to the plurality of speakers, and an information processing terminal 5 connected to the acoustic characteristic adjuster 3. Herein, the plurality of speakers is constituted by speakers 51A through 51L, speakers 61A through 61M, and speakers 71A through 71C.

The room 62 constitutes a space having a substantially rectangular parallelepiped shape. A sound source 65 is disposed on a stage 60 in a forward portion of the room 62. A backward portion of the room 62 corresponds to an audience seat area 63 in which audience seats where listeners sit down are arranged. The backward portion of the room 62 is further provided with a second-floor seat area (balcony seat area) 64 in which second floor seats (balcony seats) are arranged. A depth of the balcony seat area 64 is longer than that of the audience seat area 63 located on the first floor. The sound source 65 includes voice, singing sound, an acoustic musical instrument, an electric musical instrument, an electronic musical instrument, and the like, for example. Note that, the shape of the room 62, arrangement of the sound source, or the like is not limited to the example of FIG. 1.

The sound system 1 includes many speakers in the room 62. As an example of the present exemplary embodiment, a ceiling of the stage is provided with three speakers 61A through 61C. A ceiling of the audience seat area 63 is provided with four speakers 61D through 61G. A ceiling of the balcony seat area 64 is provided with three speakers 61H through 61J. A ceiling on a lower side of the balcony seat area 64 is provided with three speakers 61K through 61M. Further, a side wall of the audience seat area 63 is provided with eight speakers 51A through 51H. A side wall of the balcony seat area 64 is provided with four speakers 51I through 51L. A backward wall of the room 62 is provided with three speakers 71A through 71C.

The speakers 61A through 61M are the same model. The speakers 51A through 51L are the same model. The speakers 71A through 71C are the same model. In other words, the acoustic system 1 of the present exemplary embodiment includes three kinds of speakers as an example.

As an example, the speakers 51A through 51L attached to the side wall and the speakers 71A through 71C attached to the backward wall are speakers having a relatively high directivity. The speakers 51A through 51J and the speakers 71A through 71C mainly output an initial-reflection-sound control signal that reproduces initial reflection sound in a predetermined space.

The speakers 61A through 61J attached to the celling are speakers having a relatively low directivity. The speakers 61A through 61J mainly output a reverberant-sound control signal that reproduces reverberant sound.

The acoustic characteristic adjuster 3 obtains a sound signal, which is related to sound of the sound source 65, through a microphone (not shown) or a line input. Further, the acoustic characteristic adjuster 3 obtains the entire sound of the room 62 through a microphone (not shown) installed in the celling or the like. Herein, the entire sound of the room 62 includes sound of the sound source 65, the reflection sound in the room 62, and the like. The acoustic characteristic adjuster 3 distributes the obtained sound signal of the sound source 65 to the speakers 51A through 51L, the speakers 61A though 61M, and the speakers 71A through 71J to perform level control, thereby making it possible to localize a sound image of the sound source 65 at a predetermined position.

Further, the acoustic characteristic adjuster 3 convolutes an impulse response, which has been measured in the predetermined space, on the obtained sound signal of the sound source 65, thereby producing an initial-reflection-sound control signal and a reverberant-sound control signal. The impulse response can be divided into direct sound, initial reflection sound, and reverberant sound that are arranged on a time axis. The acoustic characteristic adjuster 3 convolutes an initial reflection sound part, i.e., a part in which the direct sound and the reverberant sound are removed from the impulse response, on the sound signal of the sound source 65, thereby producing the initial-reflection-sound control signal. Further, the acoustic characteristic adjuster 3 convolutes a reverberant sound part, i.e., a part in which the direct sound and the initial reflection sound are removed from the impulse response, on the sound signal of the sound source 65, thereby producing a reverberant-sound control signal.

The acoustic characteristic adjuster 3 supports a sound field in the above-mentioned manner. Herein, the information processing terminal 5 corrects output characteristics of the speakers 51A through 71J. The information processing terminal 5, which is an example of the acoustic characteristic correction device of the present disclosure, is constituted by an information processing device such as a personal computer or a smart phone. Note that, the acoustic characteristic adjuster 3 may have a configuration and a function of the information processing terminal 5. In this case, the acoustic characteristic adjuster 3 is an example of the acoustic characteristic correction device of the present disclosure.

As shown in FIG. 2, the information processing terminal 5 includes a microphone 11, a display 12, a user interface (I/F) 13, a flash memory 14, a CPU 15, a RAM 16, and a network I/F 17.

The CPU 15 reads out a program (instructions) stored in the flash memory 14, serving as a storage medium, to the RAM 16 and achieves the predetermined function. In this example, for performing a plurality tasks such as measuring task, calculating task, correcting task, and warning task, the CPU 15 constitutes a measurement portion 151, an average characteristic calculator 152, and a corrector 153. Note that, it is not necessary to store the program, which is read out by the CPU 15, in its own flash memory 14. For instance, the program may be stored in a storage medium of an external device such as a server. In this case, the CPU 15 may read out the program to the RAM 16 from the server and execute it, as necessary.

The network I/F 17 is connected to the acoustic characteristic adjuster 3 in a wireless or wired manner. The information processing terminal 5 transmits and receives information to and from the acoustic characteristic adjuster 3 via the network I/F 17. By measuring the output characteristics of the speakers, the information processing terminal 5 grasps an individual difference of each of the plurality of speakers and an influence of attachment conditions to the room 62 on frequency characteristics.

Figure 3:
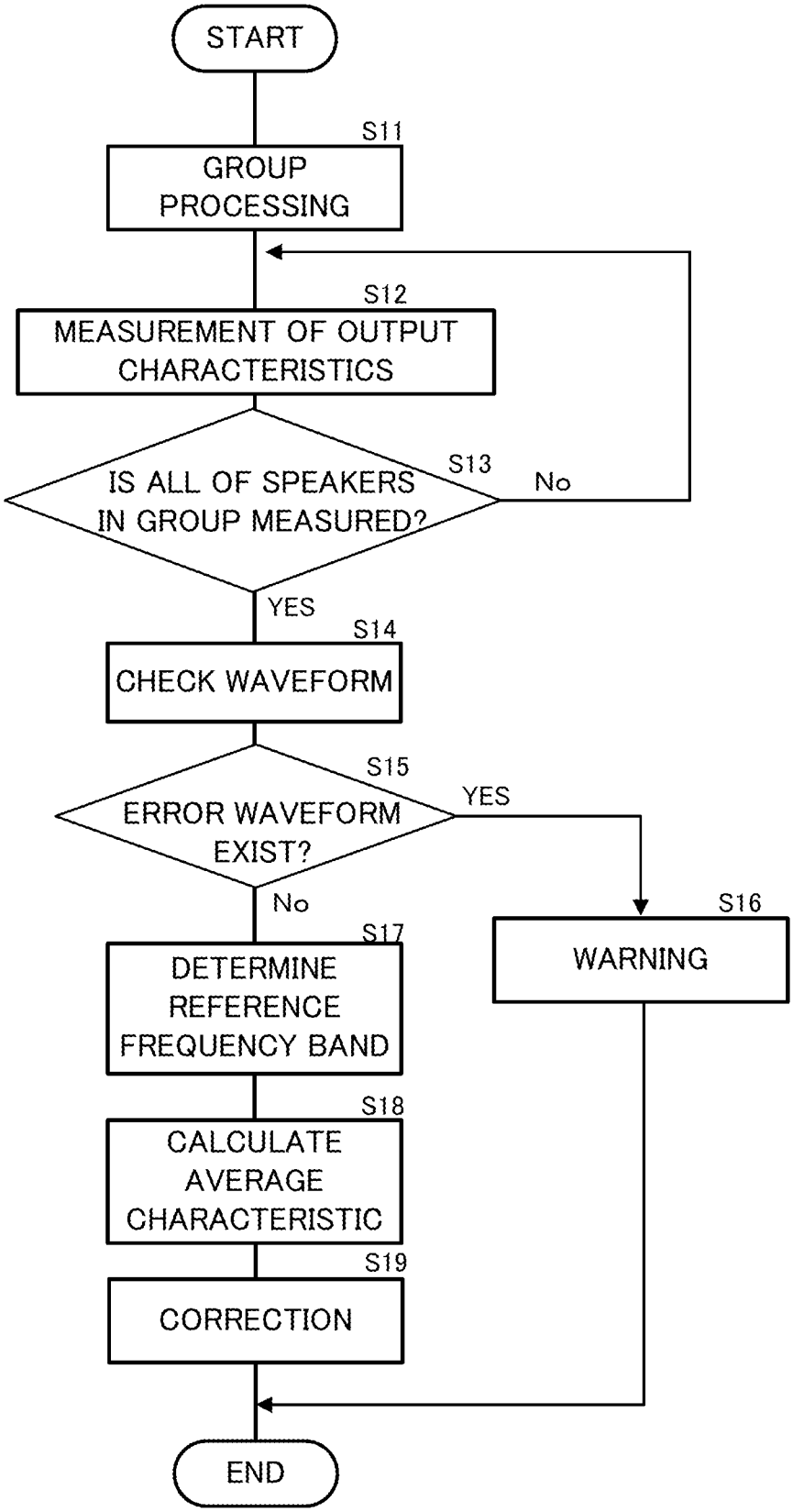
FIG. 3 is a flow chart showing an operation of an information processing terminal 5.

FIG. 3 is a flow chart showing an operation of the information processing terminal 5. First, the information processing terminal 5 performs grouping processing (S11) (measuring task). The grouping processing is a process of grouping a plurality of speakers each having the same or similar attachment conditions. The attachment conditions include a model of the speaker, a material of an attachment surface of the speaker, and a shape of the attachment surface of the speaker, for example. Further, the attachment conditions include an area (the stage 60, the audience seat area 63, or the balcony seat area 64) where sound of the speaker is emitted, or the like.

In the example of FIG. 1, the speakers 61A through 61C are attached to the ceiling of the stage 60 and directed vertically downward. Accordingly, the information processing terminal 5 groups the speakers 61A through 61C. The speakers 61D through 61G are attached to the ceiling of the audience seat area 63 and directed vertically downward. Accordingly, the information processing terminal 5 groups the speakers 61D through 61G. The speakers 61H through 61J are attached to the ceiling of the balcony seat area 64 and directed vertically downward. Accordingly, the information processing terminal 5 groups the speakers 61H through 61J. The speakers 61K through 61M are attached to the ceiling located directly below the balcony seat area 64 and directed vertically downward. Accordingly, the information processing terminal 5 groups the speakers 61K through 61M.

The speakers 51A through 51H are attached to the side wall of the audience seat area 63 and directed sideways. However, the speaker 51G and the speaker 51H are attached to a corner. Thus, the attachment surfaces of the speaker 51G and the speaker 51H are different in shape from the attachment surfaces of the speakers 51A through 51F. Therefore, the information processing terminal 5 groups the speakers 51A through 51F, and groups the speaker MG and the speaker 51H. The speakers 51I through ML are attached to the side wall of the balcony seat area 64 and directed sideways. Therefore, the information processing terminal 5 groups the speakers 51I through 51L. The speakers 71A through 71C are attached to a backward portion of the balcony seat area 64 and directed forward. Therefore, the information processing terminal 5 groups the speakers 71A through 71C.

The installation position of each speaker is obtained based on coordinates on CAD data exhibiting the shape of the room 62, for example. For each speaker, a user of the information processing terminal 5 previously inputs the installation position, the direction, a model, a material of the attachment surface, the shape, or the like. According to these, the information processing terminal 5 performs the grouping processing. Note that, the grouping processing may be set in advance manually through the user I/F 13 by a user of the information processing terminal 5.

Next, the measurement portion 151 of the information processing terminal 5 measures each of output characteristics of the plurality of speakers that have been grouped (S12) (measuring task). Through the network I/F 17, the measurement portion 151 instructs the acoustic characteristic adjuster 3 to output measurement sound from the corresponding speaker. Among the four speakers 61D through 61G constituting one group, the measurement portion 151 causes the speaker 61D to output the measurement sound first, for example. As the measurement sound, a white noise, a pink noise, or Time Stretched Pulse is employed. The measurement portion 151 measures an impulse response of the measurement sound through the microphone 11, as an output characteristic of the speaker. To measure the output characteristic, a user of the information processing terminal 5 moves the microphone 11 to a measurement point. The measurement point is a position located away from the speaker by a predetermined distance (e.g., ranging from approximately 2 m to 3 m) on an axis of the speaker. In the same group, the predetermined distance is the same.

Subsequently, the measurement portion 151 determines whether the output characteristics of all the speakers in the group have been measured or not (S13). When an unmeasured speaker exists (S13: No), the measurement portion 151 returns to the processing of S12, and measures an output characteristic of the unmeasured speaker. Note that, in the case of changing the speaker as a measurement target, a user of the information processing terminal 5 moves the microphone 11 to a measurement point of the target speaker. Alternatively, in the case where a microphone has been installed in a measurement location of each speaker, e.g., if a plurality of microphones have been installed in the audience seat area 63, it will not be necessary to move the microphone 11.

When determining that the output characteristics of all the speakers in the group have been measured (S13: Yes), the measurement portion 151 performs waveform check (S14).

Figure 4:
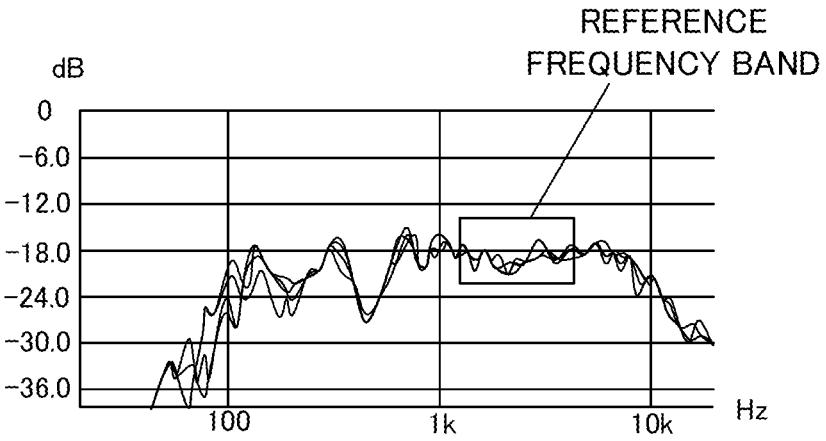
FIG. 4 is a view showing frequency characteristics.

The waveform check is a process of comparing a plurality of output characteristics that have been measured. FIG. 4 is a view showing frequency characteristics among the measured output characteristics, and FIGS. 5 and 6 are views showing phase characteristics.

Figure 5:
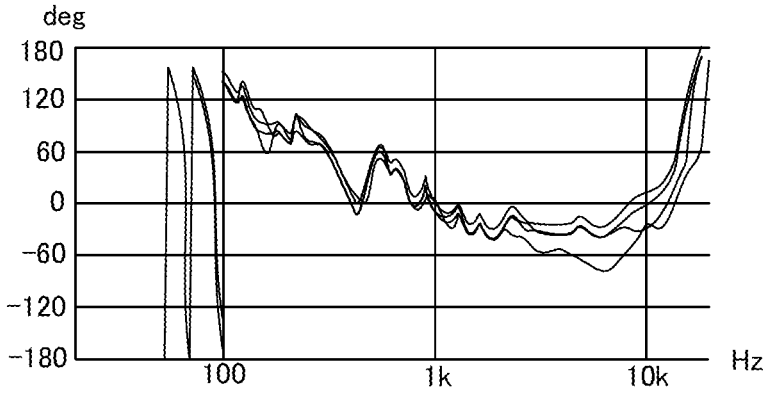
FIG. 5 is a view showing phase characteristics.

The measurement portion 151 calculates the frequency characteristics shown in FIG. 4 and the phase characteristics shown in FIG. 5 based on the obtained output characteristics. In the plurality of speakers that have been grouped, the attachment conditions are the same. Therefore, the frequency characteristics and the phase characteristics thereof are similar.

Figure 6:
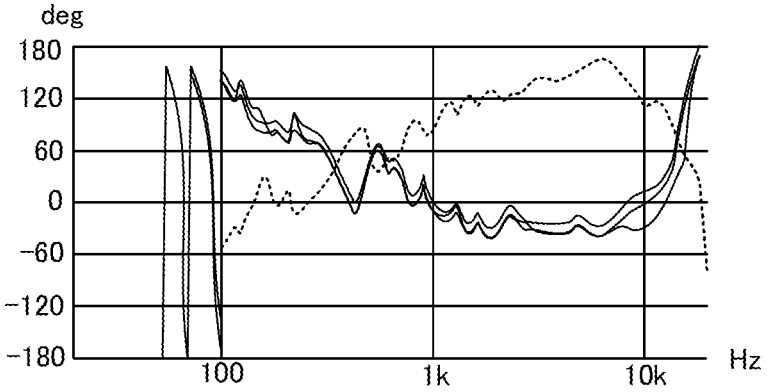
FIG. 6 is a view showing phase characteristics.

As shown in the dashed line of FIG. 6, however, if positive and negative polarities of the speaker are incorrectly wired, an output characteristic whose phase is reversed will occur. The measurement portion 151 determines whether such an error waveform is detected or not (S15). If the error waveform is detected (S15: Yes), the measurement portion 151 will issue a warning (S16). As the warning, the measurement portion 151 may display it on the display 12, or may emit sound from a speaker (not shown) of the information processing terminal 5, for example. Note that, other than inversion of the phase, when a difference between the output characteristic and an average characteristic, described later, is more than or equal to a predetermined value, the measurement portion 151 may also issue a warning.

When the measurement portion 151 detects no error waveform (S15: No), an average characteristic calculator 152 determines a reference frequency band (S17) and calculates an average characteristic (S18) (calculating task).

The reference frequency band is a frequency band that serves as a reference of offset processing for unifying the output characteristics of the plurality of speakers. In the example shown in FIG. 4, the average characteristic calculator 152 determines a band ranging from approximately 2.5 kHz to 5 kHz as the reference frequency band. The reference frequency band may be determined manually using the user I/F 13 by a user of the information processing terminal 5, or may be determined based on a predetermined standard by the average characteristic calculator 152. For instance, as the reference frequency band, the average characteristic calculator 152 determines a band in which difference between output characteristics of the plurality of speakers is the smallest. Alternatively, as the reference frequency band, the average characteristic calculator 152 may determine a band indicating a frequency characteristic closest to the frequency characteristic in an ideal state at the measurement point. The frequency characteristics in an ideal state may be obtained using an acoustic numerical simulation, for example.

The average characteristic calculator 152 offsets the frequency characteristics such that a level of each of the plurality of speakers within the reference frequency band becomes 0 dB. First, the average characteristic calculator 152 calculates an average value of the output characteristic of each speaker within the reference frequency band as the level within the above-mentioned reference frequency band. For instance, the average characteristic calculator 152 calculates an average value of amplitude within the reference frequency band as a level within the above-mentioned reference frequency band. As an example, in the group constituted by the four speakers 61D through 61G, the level of the speaker 61D is −20.2247 dB, the level of the speaker 61E is −21.7228 dB, the level of the speaker 61F is −20.5243 dB, and the level of the speaker 61G is −21.1236 dB. Accordingly, the average characteristic calculator 152 sets an amount of offset of the speaker 61D to 20.2247 dB, sets an amount of offset of the speaker 61E to 21.7228 dB, sets an amount of offset of the speaker 61F to 20.5243 dB, and sets an amount of offset of the speaker 61G to 21.1236 dB.

Figure 7:
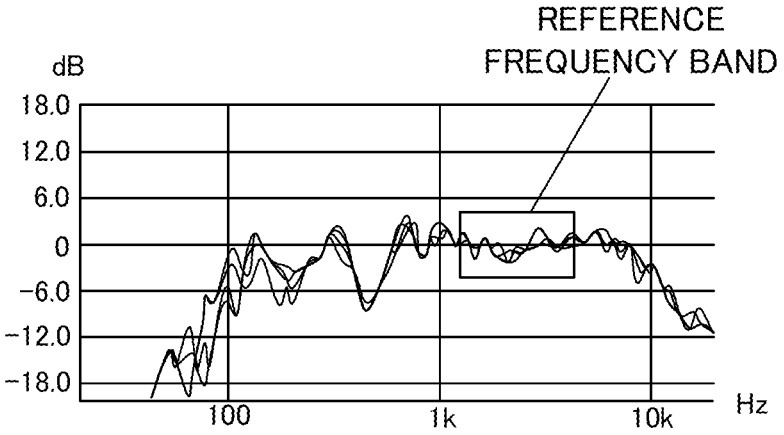
FIG. 7 is a view showing frequency characteristics after offset.

FIG. 7 is a view showing frequency characteristics after offset. As shown in FIG. 7, the average characteristic calculator 152 offsets the frequency characteristic of each speaker such that the level within the reference frequency band becomes 0 dB. Then, the average characteristic calculator 152 averages the frequency characteristic of each speaker after the offset to obtain an average characteristic.

Figure 8:
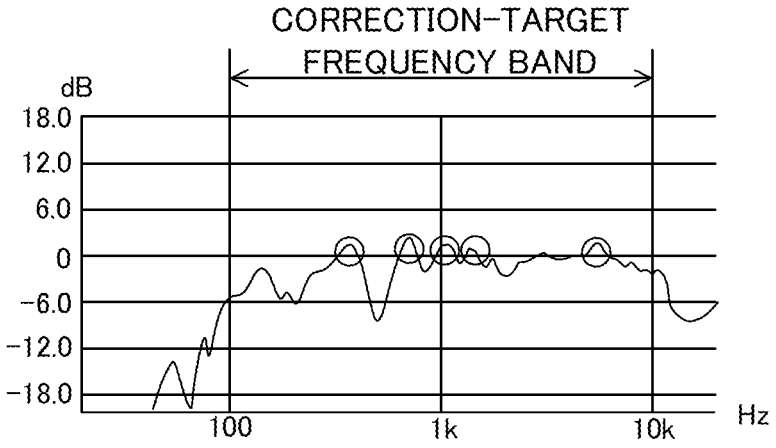
FIG. 8 is a view showing an average characteristic.

FIG. 8 is a view showing an average characteristic. The corrector 153 corrects each of output characteristics of the plurality of speakers based on the average characteristic (S19) (correcting task). The corrector 153 corrects the output characteristics at a frequency where the local maximum component exceeds 0 dB within a correction-target frequency band, for example. The correction-target frequency band is determined based on reproduction capability of the speakers. For instance, since a lower-limit reproducible frequency of the speakers 61D through 61G ranges from 100 Hz to 10 kHz, the correction-target frequency band is set to be 100 Hz or more.

In the average characteristic of FIG. 8, the local maximum components exceeding 0 dB are located at 350 Hz, 800 Hz, 1.2 kHz, 1.5 kHz, and 5.5 kHz as shown by the circles of the figure. The corrector 153 sets a filter property such that the local maximum components exceeding 0 dB are corrected to 0 dB.

Figure 9:
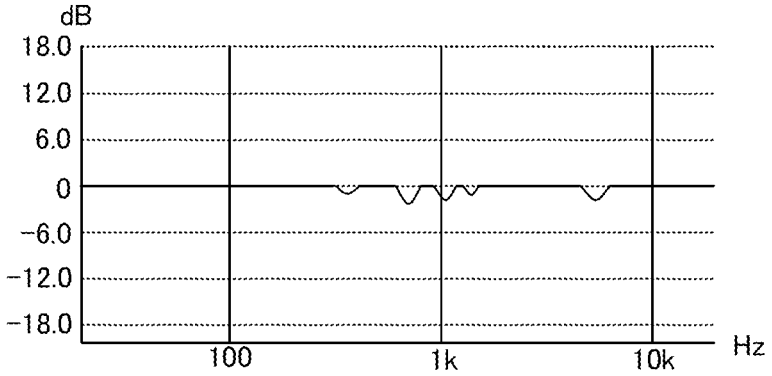
FIG. 9 is a view showing a filter property.

FIG. 9 is a view showing a filter property. In order to correct the local maximum components, which exceed 0 dB in the average characteristic shown in FIG. 8, to 0 dB, the corrector 153 sets a center frequency, a gain, and Q value to have an inverse characteristic of the average characteristic.

Note that, the phase may be set to a minimum phase or a linear phase. In the case where the phase is set to a minimum phase, the corrector 153 produces a filter property that has a frequency characteristic (frequency characteristic based on the average characteristic) representing the group, while keeping a change in phase minimum. Thus, necessary and sufficient correction can be performed for the plurality of speakers in the group.

The corrector 153 performs inverse Fourier transform of such a filter property to obtain a filter coefficient (impulse response) of an FIR filter. Then, the corrector 153 transmits the filter coefficient to the acoustic characteristic adjuster 3 through the network I/F 17, and sets it to the FIR filter of the acoustic characteristic adjuster 3.

Note that, in the example of FIG. 9, the corrector 153 determines the local maximum component exceeding 0 dB as a correction target, but may extract a local minimum component, for example. Further, if a difference between the local maximum component and 0 dB or a difference between the local minimum component and 0 dB is too large (e.g., a difference value exceeds 6 dB), the local maximum component or the local minimum component may be removed from the correction target. Further, the corrector 153 may calculate coherence. If being less than a predetermined value, the coherence may be removed from the correction target, because the corrector 153 determines that phase interference, which is caused by reflection of a wall or the like, occurs.

Further, the corrector 153 may perform not only a correction of the frequency characteristics but also a volume level correction. For instance, the corrector 153 calculates an average level of the plurality of speakers in the group. The corrector 153 performs a level correction such that the level of each speaker among the plurality of speakers is aligned to the average level. For instance, in the group constituted by the four speakers 61D through 61G, it is assumed that the level of the speaker 61D is −20.2247 dB, the level of the speaker 61E is −21.7228 dB, the level of the speaker 61F is −20.5243 dB, and the level of the speaker 61G is −21.1236 dB. In this case, an average level of −20.90 dB is obtained. Accordingly, the corrector 153 sets an amount of level correction of the speaker 61D to −0.6753 dB, sets an amount of level correction of the speaker 61E to 0.8228 dB, sets an amount of level correction of the speaker 61F to −0.3757 dB, and sets an amount of level correction of the speaker 61G to 0.2236 dB. Thus, the sound outputted from each speaker has the same level at a position whose distance from each of the speakers is the same.

As mentioned above, the acoustic characteristic correction device of the present exemplary embodiment can adjust acoustic characteristics of a plurality of speakers automatically. The acoustic characteristic correction device is not necessary to adjust a plurality of speakers one by one individually, thereby making it possible to shorten adjustment time significantly. On the other hand, in a group of which attachment conditions are the same, the acoustic characteristic correction device produces a filter property that has a frequency characteristic (frequency characteristic based on an average characteristic) representing the group. Therefore, an adjustment for obtaining a uniform frequency characteristic and a uniform level is made possible in the group. Thus, the acoustic characteristic correction device of the present exemplary embodiment can correct output characteristics of a plurality of speakers quantitatively with respect to a target characteristic, thereby making it possible to reduce time and effort required for the correction.

The description of the present embodiments is illustrative in all respects and is not to be construed restrictively. The scope of the present disclosure is indicated by the appended claims rather than by the above-mentioned embodiments. Furthermore, the scope of the present disclosure is intended to include all modifications within the meaning and range equivalent to the scope of the claims.

For instance, the present exemplary embodiment shows an example that outputs an initial-reflection-sound control signal and a reverberant-sound control signal to support a sound field, but to support a sound field is not essential in the present disclosure. Further, the correction method of acoustic characteristics in the present disclosure is applicable to any room, i.e., as long as a plurality of speakers are installed, not limited to a big acoustic space such as a concert hall.

What is claimed is:

1. A correction method of acoustic characteristics of a plurality of speakers installed in a room, the correction method comprising:

grouping speakers, among the plurality of speakers, having an identical attachment condition to the room and measuring each of output characteristics of the grouped speakers;

calculating an average characteristic of the output characteristics of the grouped speakers by:

determining a reference frequency band; and offsetting the output characteristics within the reference frequency band to a predetermined value to calculate the average characteristic; and correcting each of the output characteristics of the grouped speakers based on the average characteristic, wherein the output characteristics at least include frequency characteristics, phase characteristics, and volume levels of the grouped speakers.

2. The correction method according to claim 1, wherein the attachment condition includes a speaker model.

3. The correction method according to claim 1, wherein the calculating of the average characteristic determines the reference frequency band based on a predetermined standard.

4. The correction method according to claim 3, wherein the calculating of the average characteristic sets a band having a minimum correction amount as the reference frequency band.

5. The correction method according to claim 1, further comprising:

issuing a warning when a difference between the average characteristic and the output characteristics of the grouped speakers among the output characteristics of the plurality of speakers is more than or equal to a predetermined value.

6. The correction method according to claim 1, further comprising:

issuing a warning when a phase of the output characteristics is reversed.

7. The correction method according to claim 1, wherein the correcting of each of the output characteristics determines a frequency band of a target to be corrected depending on reproduction capability of the plurality of speakers.

8. The correction method according to claim 1, wherein the attachment condition includes a material and a shape of an attachment surface.

9. An acoustic characteristic correction device for correcting acoustic characteristics of a plurality of speakers installed in a room, the acoustic characteristic correction device comprising:

a memory storing instructions; and a processor that implements the instructions to execute a plurality of tasks, including:

a measuring task that groups speakers, among the plurality of speakers, having an identical attachment condition to the room and measures each of output characteristics of the grouped speakers;

a calculating task that calculates an average characteristic of the output characteristics of the grouped speakers by:

determining a reference frequency band; and offsetting the output characteristics within the reference frequency band to a predetermined value to calculate the average characteristic; and a correcting task that corrects each of the output characteristics of the grouped speakers based on the average characteristic, wherein the output characteristics at least include frequency characteristics, phase characteristics, and volume levels of the grouped speakers.

10. The acoustic characteristic correction device according to claim 9, wherein the attachment condition includes a speaker model.

11. The acoustic characteristic correction device according to claim 9, wherein the calculating task determines the reference frequency band based on a predetermined standard.

12. The acoustic characteristic correction device according to claim 11, wherein the calculating task sets a band having a minimum correction amount as the reference frequency band.

13. The acoustic characteristic correction device according to claim 9, wherein the plurality of tasks include:

a warning task that issues a warning when a difference between the average characteristic and the output characteristics of the grouped speakers among the output characteristics of the plurality of speakers is more than or equal to a predetermined value.

14. The acoustic characteristic correction device according to claim 9, wherein the plurality of tasks include:

a warning task that issues a warning when a phase of the output characteristics is reversed.

15. The acoustic characteristic correction device according to claim 9, wherein the correcting task determines a frequency band of a target to be corrected depending on reproduction capability of the plurality of speakers.

16. The acoustic characteristic correction device according to claim 9, wherein the attachment condition includes a material and a shape of an attachment surface.

17. A non-transitory storage medium storing a program executable by a computer to execute a correction method of acoustic characteristics of a plurality of speakers installed in a room, the correction method comprising:

grouping speakers, among the plurality of speakers, having an identical attachment condition to the room and measuring each of output characteristics of the grouped speakers;

calculating an average characteristic of the output characteristics of the grouped speakers by:

determining a reference frequency band; and offsetting the output characteristics within the reference frequency band to a predetermined value to calculate the average characteristic; and correcting each of the output characteristics of the grouped speakers based on the average characteristic, wherein the output characteristics at least include frequency characteristics, phase characteristics, and volume levels of the grouped speakers.

* * * * *